United States Patent [19]

Sikora

[11] 4,384,679

[45] May 24, 1983

[54] BURNER NOZZLE

[76] Inventor: Marian Sikora, Skolgatan 6, S-290 70 Svängsta, Sweden

[21] Appl. No.: 234,386

[22] Filed: Feb. 13, 1981

[30] Foreign Application Priority Data

Feb. 15, 1980 [SE] Sweden ..... 8001193

[51] Int. Cl.[3] ..... F23D 11/38

[52] U.S. Cl. ..... 239/462; 239/493; 239/600

[58] Field of Search ..... 239/462, 487–489, 239/491, 493, 600

[56] References Cited

U.S. PATENT DOCUMENTS

| | | | |
|---|---|---|---|
| 1,461,545 | 7/1923 | Purnell | 239/462 |
| 1,543,769 | 6/1925 | Hewlett et al. | 280/663 |
| 2,055,864 | 9/1936 | Harsch | 239/462 |
| 2,556,493 | 6/1951 | Fairfield et al. | 239/462 |
| 2,660,387 | 11/1953 | Roy | 248/21 |
| 2,762,657 | 9/1956 | Wilson | 239/493 |
| 2,850,276 | 9/1958 | Jackson | 280/663 |
| 3,429,545 | 2/1969 | Michel | 248/358 |
| 3,572,621 | 3/1971 | Whitten et al. | 267/178 |
| 3,684,194 | 8/1972 | Wayne | 239/493 |
| 4,280,717 | 7/1981 | Hanai et al. | 280/663 |

FOREIGN PATENT DOCUMENTS

| | | | |
|---|---|---|---|
| 401567 | 9/1909 | France | 239/491 |
| 1079675 | 6/1953 | France | 280/663 |
| 715796 | 6/1954 | United Kingdom | 280/663 |

*Primary Examiner*—Andres Kashnikow

*Attorney, Agent, or Firm*—B. P. Fishburne, Jr.

[57] ABSTRACT

A pressure-jet oil burner nozzle includes a body having a threaded rear connecting socket to connect the nozzle to a pressure oil conduit. The nozzle includes a front nozzle tip connected to the body and having an oil discharge passage, and an insert having a front end provided with grooves disposed in the nozzle body with the front end disposed close to the side of the nozzle tip facing the interior of the body whereby the grooves, together with the inner side of the nozzle tip, define flow passages leading from the nozzle body to the oil discharge passage in the tip.

4 Claims, 4 Drawing Figures

BURNER NOZZLE

This invention relates to a nozzle for a pressure-jet oil burner comprising a body having a threaded rear connecting socket for connecting the nozzle to a pressure oil conduit, and a front nozzle end or tip in which there is formed an oil discharge passage.

Prior art burner nozzles are usually provided with a number of tangential passages opening into a small turbulence chamber, where the oil is set in very rapid rotation, usually in a direction of rotation opposite to that of a flow of secondary air about and along the outer side of the nozzle. From the turbulence chamber a fine axial hole opens into the tip of the burner nozzle. By a special design of the tangential passages in relation to the axial hole or passage in the nozzle tip the oil is projected in the form of spray of fine oil particles which are conically spread at a certain predetermined angle. It is important that the angle of the oil cone is maintained as invariable as possible in the use of the nozzle to provide an effective mixing thereof with secondary air and a favourable combustion economy, but also to safeguard reliable ignition by means of an electric ignitor which is normally used.

However, for various reasons, the shape of the fine discharge passage changes during operation of the burner, such as by wear at the mouth and because of coatings, whereby the fine distribution of the oil is deteriorated, resulting in an incomplete and uneconomical combustion, and furthermore the formation of soot particles will increase and ignition trouble may arise.

In spite of the cost of new nozzles, it is therefore more economical to relatively often replace the nozzle instead of using the same nozzle for a longer time.

The costs of changing nozzles may vary in dependence on the construction of the nozzle. A nozzle of a customary type consists of two main parts one of which forms a body for the other part which is a rod-shaped member, the so-called needle, which in some embodiments is provided with a threaded portion adapted to be screwed into an internal thread of the body. The body usually is in the form of a cap nut with a rearwardly projecting externally and internally threaded pipe socket. The closed front end of the body, which is similar to a cap nut, forms a nozzle tip in which the fine discharge passage is formed. The rear threaded pipe socket of the body is adapted to permit establishing a screw connection with the oil supply pipe. The threaded portion of the needle is pierced by axial flow channels and a cylindrical front end portion of the needle defines with the inner side of the body a space for permitting oil to flow to the turbulence chamber which is defined by a conical or frusto-conical end of the needle and a usually conical inner side at the bottom of the body (nozzle tip) connecting onto the discharge opening. To impart the desired turbulent movement to the oil the conical end surface of the nozzle is provided with oblique or helical fine channels.

Many variants of this design have become known. The needle may for example have the form of a very short cylindrical member which has a frusto-conical end and is retained in position in the housing by means of a threaded plug screwed into the body so as to engage the rear end of the needle, oil channels being provided either through the plug or between the plug and the inner side of the body. Further, it is customary to equip the nozzle with an oil filter of some kind.

Upon exchange of burner nozzles of prior art design, at least the entire body, which usually is made of brass, has to be discarded even if its only defect is an unsatisfactory discharge opening in the nozzle tip. However the entire nozzle inclusive of the needle is often discarded by reason of the suspicion that the tangential or helical passages are also damaged or clogged.

The present invention has for its object to provide a burner nozzle which is quite as effective as prior art burner nozzles and need not be exchanged in its entirety but can be restored into fully satisfactory condition in an economical way both with regard to material costs and labour costs.

This object has been realized in a burner nozzle according to the invention by the features that will appear from the following description and the appendant claims.

The invention will be described in greater detail below with reference to the accompanying drawings in which.

Figure 1:
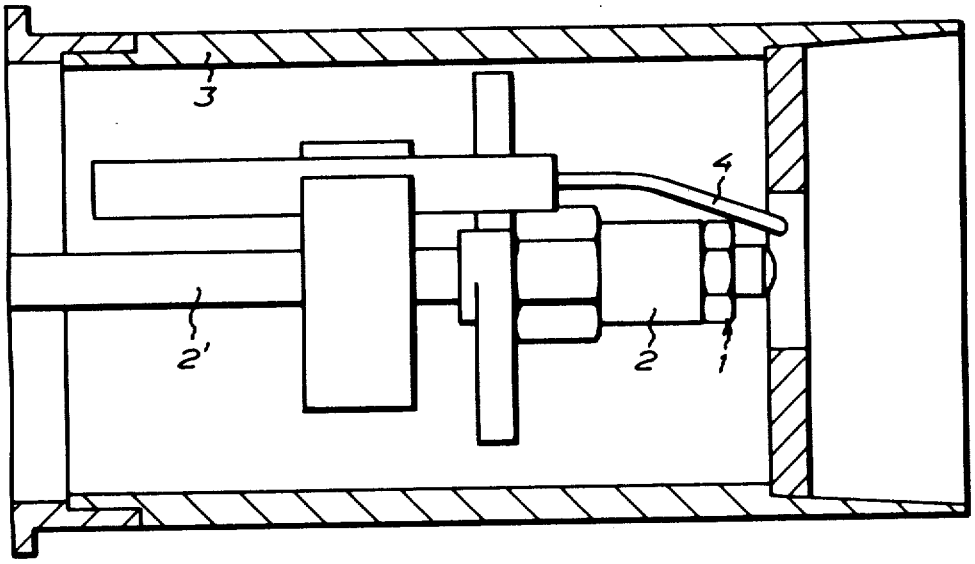
FIG. 1 is an axial sectional view of a burner equipped with a nozzle according to the invention which is connected to an oil supply conduit.

The nozzle 1 illustrated in FIG. 1 is mounted in a sleeve-shaped connecting member 2 at the end of an oil supply pipe 2' and surrounded by a cylindrical outer casing 3 through which air is blown to the region about the mouth of the nozzle. 4 designates an electrical ignitor.

Figure 2:
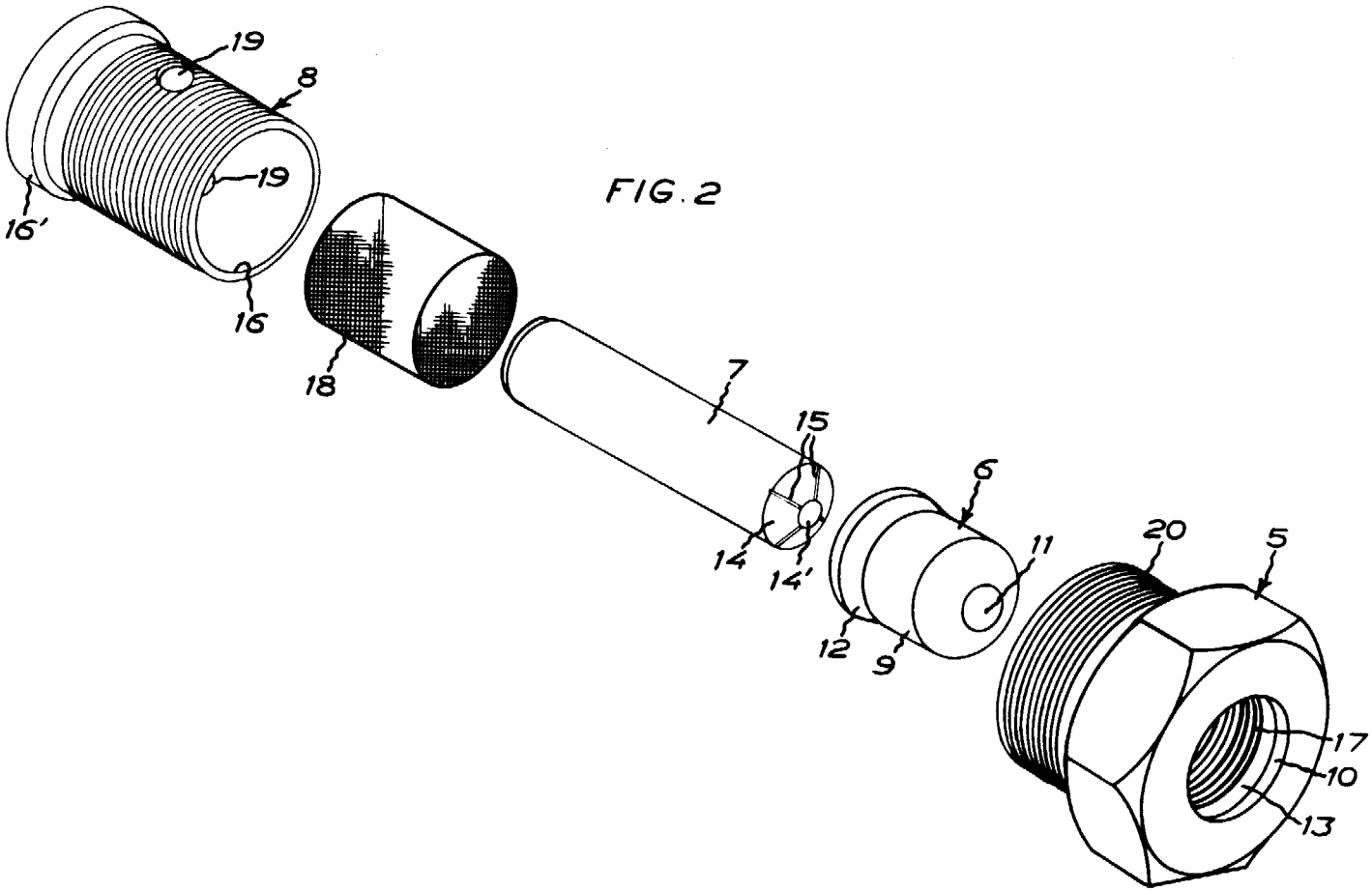
FIG. 2 is a perspective exploded view of the various parts of the nozzle in FIG. 1 in their correct positions for assembly.

The nozzle 1 in FIG. 1 resembles an ordinary burner nozzle but is of the construction shown in FIG. 2 which differs from conventional constructions int. al. by the nozzle tip being a separate element.

The nozzle shown in FIG. 2 consists of four separate elements, viz. a nozzle body 5, a nozzle tip 6, a needle 7 and a needle and filter holder 8.

The nozzle body 5 shown in FIG. 2 is substantially of the same outer shape as a conventional nozzle body from which the nozzle tip is cut away. In the nozzle according to the invention the nozzle tip 6 is formed by a separate element which is insertable in the body 5 from the rear open end of the body such that the nozzle tip with its front end portion 9 protrudes through a central hole 10 at the front end of the body 5 some distance beyond the body. The nozzle tip 6 is hat-shaped and a conventional oil discharge opening 11 is provided in the top end thereof. At its rear end the nozzle tip 6 has a flange-like shoulder 12 which after the insertion of the nozzle tip 6 in the body 5 snugly engages a seat 13 of complementary shape in said body. A sealing ring of suitable material may be disposed between the surfaces 12 and 13. After insertion of the nozzle tip 6 in the body 5 these parts together have the outer appearance of the nozzle 1 in FIG. 1, which fundamentally coincides with the outer appearance of a conventional burner nozzle.

The nozzle needle 7 is a cylindrical member having a frusto-conical tapering end 14 which, as is the case in conventional nozzles, is adapted to engage a conical bottom surface at the bottom of the nozzle tip 6, from where the discharge opening 11 extends, and to define by means of its, for instance planar, end 14' to define a turbulence chamber in the nozzle tip of the same type as the turbulence chamber in conventional burner nozzles. Like conventional nozzle needles, the needle 7 has a number of helical or oblique channels 15 provided in the frusto-conical front end surface 14 to impart a rotary movement to the oil while letting it pass to the turbulence chamber.

The needle and filter holder 8 is in a form of a sleeve having an externally threaded sleeve wall 16 for engagement with an internal thread 17 of the nozzle body 5. The sleeve 16 has a sufficiently large diameter to accommodate the rear end portion of the needle 7 and a cylindrical oil filter 18 disposed on the needle, said sleeve having a rear end wall 16' which serves to support the rear ends of the needle 7 and the filter 18. A hexagonal hole or a bottom hole of hexagonal shape (see FIG. 3) for a hexagon socket head wrench may be formed in said rear end wall. A supporting surface (not shown) for the front end of the filter 18 is arranged in the rear end of the hat-shaped nozzle tip.

The hollow space in the nozzle tip has a slightly larger diameter than the needle 7 such that after insertion of the front end portion of the needle 7 in the nozzle tip 6 to realize engagement between the annular frusto-conical surface 14 and a corresponding supporting surface at the bottom of the nozzle tip 6, an annular space is defined between the circumferential surface of the needle 7 and the inner circumferential surface of the nozzle tip 6. The wall 16 of the sleeve is provided with inlet holes 19 for oil which has to pass through the filter 18 to reach the turbulence chamber in the front end of the nozzle tip 6.

The externally threaded sleeve 8 is meant to be screwed into the body 5 which for this purpose has an internal thread. When the elements are assembled and the sleeve 8 screwed into the body 5, the shoulder surface 12 of the nozzle tip 6 is applied against the seat 13 of the body 5 and the front end 14 of the needle 7 engages the bottom of the nozzle tip 6 in the manner described, the elements being kept firmly together by the screw connection established between the sleeve 8 and the body 5, while the rear end portion of the sleeve having the oil inlet holes 19 extends freely rearwardly from the externally threaded rear socket 20 of the body 5, said socket being arranged to be screwed in a conventional manner into the connecting member 2 of the oil pipe 2' (see FIG. 1). In the assembled position shown in FIG. 1 that part of the sleeve 8 which extends rearwardly from the threaded socket 20 of the nozzle body 5 projects freely into the connecting member 2 so that oil can enter through the oil inlet holes 19 of the sleeve 8.

Figure 3:
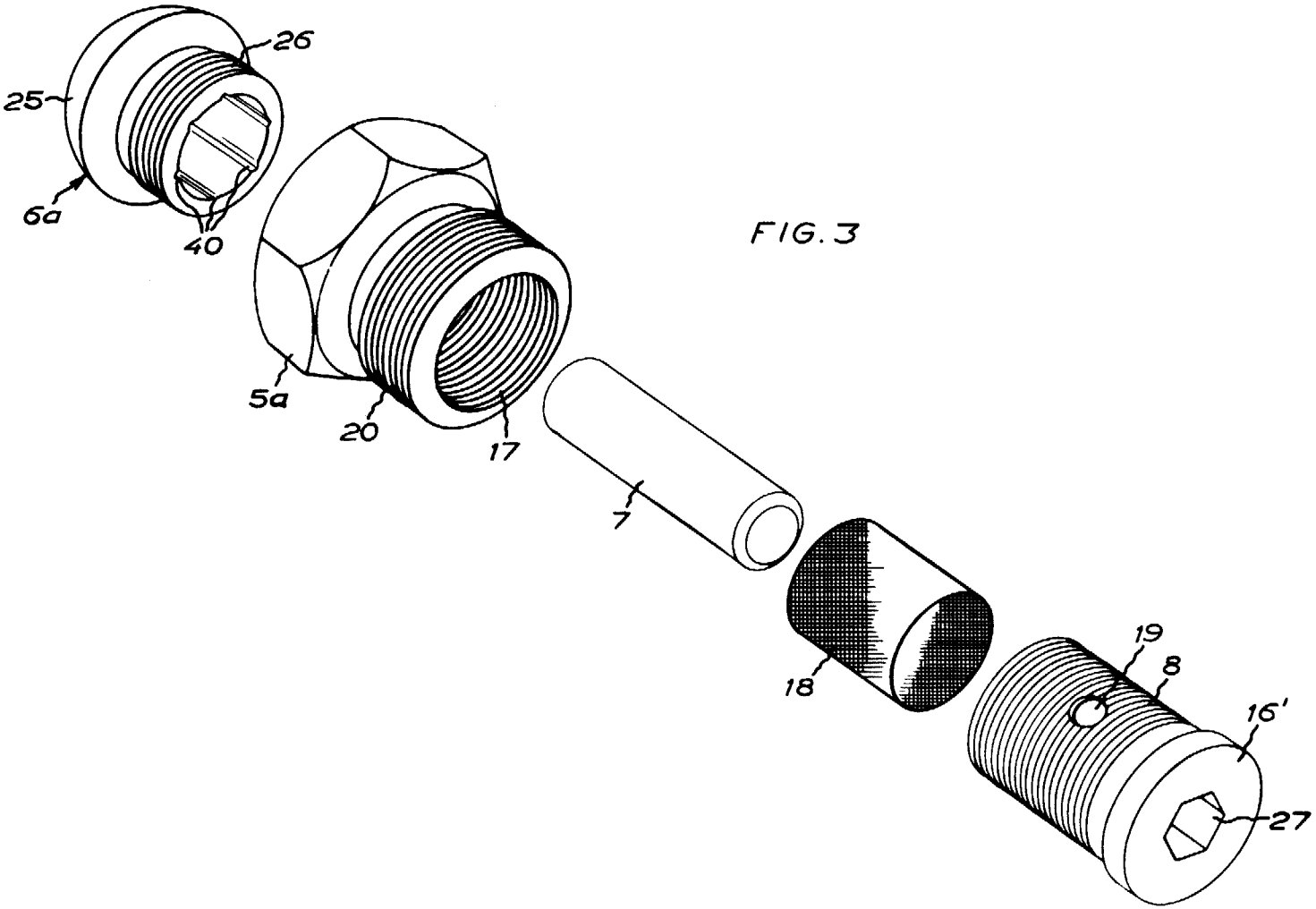
FIG. 3 is a similar perspective exploded view showing a modification of the nozzle tip.

The embodiment illustrated in FIG. 3 corresponds to that of FIG. 2 except that the nozzle tip designated 6*a* in FIG. 3 has a relatively short front external, for instance semi-spherical, portion 25 and a tapering socket-shaped rear portion 26 which is threaded to permit screwing of the nozzle tip 6*a* into a threaded hole in front end of the body 5*a* which differs from the body 5 in FIG. 2 only in that the front hole 10 in the body 5 in FIG. 2 is threaded in the embodiment shown in FIG. 3. The needle 7 and the sleeve 8 in FIG. 3 are the same construction as the corresponding elements in FIG. 2, and in FIG. 3 the hexagonal hole 27 is shown at the rear end of the sleeve 8 to permit screwing the sleeve into the body 5 by means of a hexagon socket head wrench. It should however be observed that the sleeve 8 could also have an imperforate bottom wall the circumference to which may be in the form of a hexagonal nut or the rear side of which may present a slot for a screw driver or a hole for a hexagon head wrench, i.e. a so-called Allen wrench.

Figure 4:
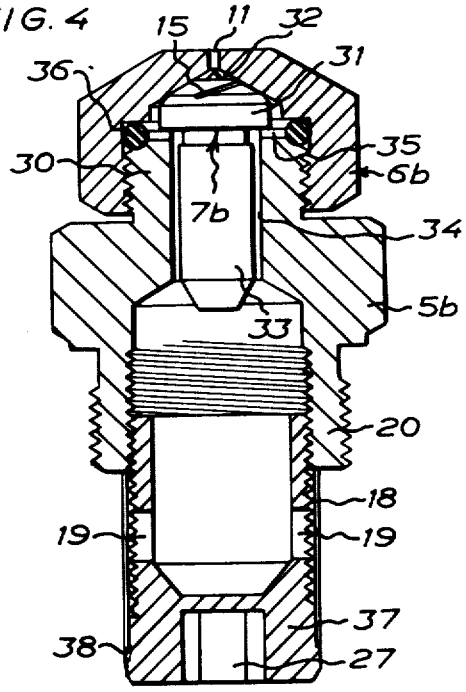
FIG. 4 is an axial section a further modified embodiment of the nozzle according to the invention.

FIG. 4 shows an embodiment which fundamentally corresponds to the embodiments described, but differs structurally from these in several respects. The nozzle tip 6*b* has substantially the shape of a simple cap nut to which there is screwed from outside a threaded socket 30 which protrudes forwardly from the body 5*b*. The rear end portion of the body 5*b* like the body 5 in FIG. 2 has a projection in the form of an internally and externally threaded socket 20. The needle 7*b* here is in the form of a pin with a head 31. Said head 31 has a cylindrical circumferential surface and a frusto-conical front end with surfaces similar to the surfaces 14, 14' in FIG. 2 to define a turbulence chamber 32 connecting onto the discharge opening 11. The stem 33 of the pin-shaped needle 7*b* extends with clearance through the cylindrical bore 34 in the front socket 30 of the body to permit passage of oil to an annular channel 35 between the front end of the socket 30 and an adjacent surface within the nozzle tip 6*b*. The needle head 31 rests on the front end of the socket 30 and is kept engaged with said front end by the nozzle tip 6*b* screwed onto the socket 30. A sealing ring 36 may be disposed between a shoulder surface in the nozzle tip and the outer edge of the end of the socket 30.

Thus, in the embodiment of FIG. 3, there is no need for a separate needle holder, but there is screwed into the rear threaded socket 20 of the body 5*b* a filter holder 37 for a cylindrical filter 18 which surrounds the middle portion of the filter holder 37 and its oil inlet holes 19, the filter bearing with its front end against the rear end of the socket 20, while the rear end of the filter bears against a shoulder 38 at the rear end of the filter holder 37.

Upon exchange of the nozzle tip 6 in the embodiment of FIG. 2 the entire nozzle is first screwed out of the connecting member 2 (see FIG. 1) and the sleeve 8 is then unscrewed from the body 5 for release of the elements 6 and 7. In the embodiment of FIG. 3 one need not even unscrew the nozzle from the connecting member 2 in FIG. 1, but one can unscrew the nozzle tip 6*a* from in front with the aid of a suitable key. To permit engagement of a key the nozzle tip 6*a* may be provided for instance with a pair of holes for a pin wrench or with planar surfaces (not shown) for an adjustable wrench, but if it is desired to prevent that unskilled persons perform exchanges of the nozzle tips, the nozzle tip 6*a* in the embodiment of FIG. 3 may be provided with a smooth, for instance spherical, top surface and the rear portion of the hollow space of the nozzle tip may be formed to permit engagement by means of a wrench which is introduced into the nozzle tip 6*a* from the rear through the rear socket 20 of the nozzle body 5*a* after the elements 7, 8, 18 have been removed. For engagement with a hexagon wrench (Allen wrench) it may suffice to provide the inner side of the nozzle tip 6*a* with six axial grooves 40.

In the embodiment of FIG. 4 the nozzle tip 6*b* in the form of a simple cap nut can be dismounted from outside in a simple manner by means of an adjustable wrench.

The invention is not restricted to the embodiments described in the foregoing, but can be modified in various ways within the scope of the appended claims.

I claim:

1. A nozzle for a pressure-jet oil burner comprising a hollow nozzle body which includes a hollow front body member and a sleeve-shaped rear body member having, respectively, threaded rear and threaded front mating parts for connection with each other and means for connecting the rear body member to a pressure oil conduit, a front nozzle tip which comprises a sleeve-shaped rear end portion and a forward end portion which closes the sleeve-shaped rear end portion at the front end thereof and forms a bottom wall of said sleeve-shaped rear end portion, said bottom wall having an oil discharge passage formed therethrough, an insert which has a front end formed with grooves and being disposed with the front end thereof received in the nozzle tip in contact with the inner side of said bottom wall of the nozzle tip, said grooves together with said inner side of said bottom wall of the nozzle tip defining flow passages leading from the hollow nozzle body to the oil discharge passage in the nozzle tip, said hollow front body member of the nozzle body being open-ended for receiving said nozzle tip in a position in which the latter closes the open front end of the hollow body member and protrudes therefrom, and said rear sleeve-shaped body member having an open front end and a bottom wall and defining with said front body member a substantially cylindrical chamber which is closed at its front end by said nozzle tip when the latter is in said inserted position and when the body members are connected, said insert having a substantially cylindrical form to be received in said chamber and clamped at its front and rear ends between said bottom walls of said nozzle tip and said rear body member to be detachably fixed therein and secured both against translation and rotation in relation to the nozzle tip.

2. A nozzle as claimed in claim 1, wherein said nozzle tip is in the form of a sleeve-shaped nipple, the nozzle tip being so dimensioned with regard to the inner diameter of the hollow body as to be insertable in the hollow open-ended front body member from the rear end thereof into a position in which the front end portion of the nozzle tip protrudes through the open-end front of the nozzle body, said front body member having a seating surface provided therein and said nozzle tip having a shoulder surface disposed at the rear end thereof and resting on said seating surface, the nozzle tip being detachably retained in said position in the front body member by means of said insert disposed in said chamber in said clamped position, said nozzle further comprising a cylindrical filter member dimensioned to be mounted on said cylindrical insert, said rear end portion of said cylindrical insert and said rear body member defining a ring-shaped space forming an oil passage and receiving said filter member mounted on said insert, said rear body member forming with said insert a filter holder member.

3. A nozzle as claimed in claim 1, wherein the nozzle tip presents an externally threaded rear socket-shaped extension and said front body member is internally threaded for engagement and connection with said socket-shaped extension of the nozzle tip.

4. A nozzle as claimed in claim 3, wherein the rear portion of the hollow space in the socket-shaped rear extension of the nozzle tip is formed to permit engagement of a tool which for screwing and unscrewing of the nozzle tip in relation to the body is insertable in the hollow space in the rear end of the nozzle tip through the rear socket of the front body portions.

* * * * *